US007048340B2

(12) United States Patent
Lammer et al.

(10) Patent No.: US 7,048,340 B2
(45) Date of Patent: May 23, 2006

(54) METHOD FOR INTRODUCING AND BLOWING ROCK DUST AND DEVICE FOR CARRYING OUT SAID METHOD

(75) Inventors: Egmont Lammer, Knittelfeld (AT); Kurt Schaffer, Seckau (AT); Grant Norman Colbert, Fredericktown, PA (US)

(73) Assignee: Voest-Alpine Bergtechnik, Zeltweg (AT)

( * ) Notice: Subject to any disclaimer, the term of this patent is extended or adjusted under 35 U.S.C. 154(b) by 0 days.

(21) Appl. No.: 10/739,774

(22) Filed: Dec. 18, 2003

(65) Prior Publication Data

US 2004/0145231 A1 Jul. 29, 2004

(30) Foreign Application Priority Data

Dec. 20, 2002 (AT) ..... A 1917/2002

(51) Int. Cl.
*E21C 35/22* (2006.01)

(52) U.S. Cl. ..... 299/12; 299/95

(58) Field of Classification Search ..... 299/10, 299/12, 95

See application file for complete search history.

(56) References Cited

U.S. PATENT DOCUMENTS

| | | | | |
|---|---|---|---|---|
| 2,521,888 | A * | 9/1950 | Wilson | 299/12 |
| 3,333,896 | A | 8/1967 | Diamanti | |
| 4,538,941 | A * | 9/1985 | Thorne | 406/143 |
| 6,224,164 | B1 * | 5/2001 | Hall et al. | 299/75 |

* cited by examiner

*Primary Examiner*—John Kreck
(74) *Attorney, Agent, or Firm*—Chapman and Cutler LLP

(57) ABSTRACT

In a method for introducing and blowing rock dust to bind carbon dust during advance working or coal mining using an advance working or mining machine, respectively, the cutting tools are retracted relative to a displaceable machine frame after having cut an outbreak or excavation. During the displacement of the machine frame into a new outbreak or excavation position, rock dust is blown onto the roof and lateral-wall surfaces laid bare by the cutting tools, through nozzles arranged on the machine frame by the aid of pressure medium such as compressed air. The advance working or mining machine used to carry out this method includes a displaceable machine frame and a carriage movably mounted on the machine frame and carrying a pivotable cantilever arm on which cutting heads or rolls are rotationally mounted, and a loading device intended to receive cut or broken material. At least one nozzle for atomizing rock dust is arranged on the displaceable machine frame and at least one storage bin and a compressed-air source are arranged on the advance working or mining machine.

15 Claims, 3 Drawing Sheets

METHOD FOR INTRODUCING AND BLOWING ROCK DUST AND DEVICE FOR CARRYING OUT SAID METHOD

BACKGROUND OF THE INVENTION

1. Field of the Invention

The invention relates to a method for introducing and blowing rocking dust to bind carbon dust during advance working or coal mining using an advance working or mining machine, respectively, and an advance working or mining machine for carrying out said method.

2. Prior Art

In underground mines various measures are taken to avoid explosions. In addition to the option of preventing sparking by the ejection of water or water-air mixtures, it is known to cover or mix with finely ground dust carbon dust deposited in coal mines particularly on the track walls such as, for instance, roofs or lateral walls, so as to provide an ignition-inhibiting mixture. Different devices have become known for the introduction of rock dust aimed to bind carbon dust. U.S. Pat. No. 4,394,975 A shows and describes a displaceable carriage that serves to introduce rock flour into the track. There, a mixer and a hose are connected to the carriage in order to enable the dust to be manually sprayed at place. Devices of this type call for extensive measures to protect the operating personnel. A discharging means for blowing finely ground dust in tracks of underground mines can be taken from DE-23 30 714 A1, in which blowing out need no longer be effected by hand and the drawback of pressure losses occurring in accordingly long discharge ducts is to be avoided, in particular. Also with that device, a previously employed advance working or mining machine has to be returned from the track in order to enable the advance movement and introduction of the respective discharge device, which involves cumbersome maneuvers. Similar holds for the configuration according to EP-149 506 as well as U.S. Pat. No. 3,871,588, which disclose large-structured devices capable of being moved to the respective position within the track. Yet, in order to enable such movements to the place of application, the advance working or mining machine must again be returned from its advance working or mining position in that case too, thus rendering continuous working impossible and involving considerable periods of interruption.

SUMMARY OF THE INVENTION

The invention aims to provide a method and device of the initially defined kind, by which the introduction of dust mixtures is feasible without any need to return the advance working machine, and hence interruption of track driving. The method according to the invention is to be carried out simultaneously with advance working and already immediately upon excavation such that the binding of dust will be ensured directly in the region of the advance working machine close to the roof and lateral wall zones without requiring any interruption of the advance working procedure, thus increasing the operating safety and, in particular, substantially reducing the risk of ignition.

To solve this object, the method according to the invention essentially consists in that the cutting tools are retracted relative to a displaceable machine frame after having cut an outbreak or excavation, and that, during the displacement of the machine frame into a new outbreak or excavation position, rock dust is blown out onto the roof and lateral-wall surfaces laid bare by the cutting tools, through nozzles arranged on the machine frame by the aid of pressure medium and, in particular, compressed air.

By merely retracting the cutting tools relative to a displaceable machine frame after having cut an outbreak or excavation, which is, for instance, readily feasible with cutting tools mounted on a carriage, the subsequent, new position of the advance working or mining machine can be directly utilized for mechanic dusting over an appropriate track section. During the retraction of such cutting tools by means of a carriage, a cutting machine automatically displaceable on a crawler mechanism can be advanced in the direction towards the mine face, and it is exactly that moving procedure in the direction towards the mine face, which enables an axial section of the track to be reliably covered with rock dust, said axial track section being close to the mine face, thus substantially increasing the overall safety. In order to ensure the optimum protection of the operating personnel, it is essential for the nozzles, which have to be arranged on the machine frame, to enter into effect only in the mine-face-near partial region on the front end of the machine during such displacement of the machine on the crawler mechanism such that the safe ventilation by suction will be feasible to the optimum degree on that site for the protection of the people present in the rear region of the track. The method according to the invention is, therefore, advantageously carried out in a manner that at least one exhaust duct is displaced in the direction towards the mine face and positioned prior to the blowing out of rock dust. This method, thus, utilizes the advance working phase in which the basic device, i.e. the frame including the crawler mechanisms is being shifted into a new position, usually by about 1 to 1.5 m, after completion of an outbreak. Following the preceding outbreak, the support of the advance working machine is retracted in order to enable such shifting of the basic device. In that phase, no anchorage can be realized either because of the local displacement of the advance working machine itself, so that it is exactly such idling always occurring in a continuous method, which can be utilized for stone dusting or rock flour blowing.

The method according to the invention is advantageously carried out in a manner that caps are removed from, or opened on, the nozzles prior to the blowing out of stone dust. Such caps, which can be folded down or removed in order to provide openings, serve to ensure the optimum protection of the nozzles during the cutting or mining operation. In order to ensure that rock or stone dust will be reliably applied even through such stationary nozzles without any risk of obstruction, the method is advantageously carried out in a manner that the rock dust is conveyed into the blow-out duct by the aid of a mechanical conveyor, particularly a screw conveyor, and that the compressed air is switched on and off in a time-delayed manner relative to said mechanical conveyance. By effecting the mechanical conveyance in a time-delayed manner relative to the feeding of compressed air, it is on the one hand ensured that an accordingly large amount of material is already present in the blow-out duct as the compressed-air is being switched on, wherein the follow-up will subsequently serve to clean the nozzles, thus counteracting any undesired blocking or obstruction of the nozzles.

In a particularly advantageous manner, the follow-on of the advance working and mining machine relative to the blow-out procedure takes place in a time-delayed manner, whereby it is ensured that the dust wall on the roof and the two lateral walls will not be interrupted by a premature displacement of the advance working machine, but will cover all of the surfaces.

The method according to the invention can, of course, be realized in a particularly preferred manner by means of a device especially adapted to the needs implied by this method. To this end, the advance working or mining machine according to the invention used to carry out the method of the invention and including a displaceable machine frame, a carriage movably mounted on said machine frame and carrying a pivotable cantilever arm on which cutting heads or rolls are rotationally mounted, and a loading means constructed to receive cut or broken material is essentially characterized in that at least one nozzle intended to atomize rock dust is arranged on the displaceable machine frame and at least one storage bin and a compressed-air source are arranged on the advance working or mining machine. Departing from such a specific advance working or mining machine in which the retractable cutting tools can be moved back relative to the machine frame along with a carriage on which a pivotable cantilever arm is mounted, wherein the machine frame itself is advantageously displaceable by means of a crawler mechanism, it will do to arrange the nozzle(s) for the atomization of rock dust on the machine frame itself and provide a suitable compressed-air source and a storage bin for the rock flour. The arrangement of the nozzle(s) on the displaceable machine frame allows the time interval required for the displacement of the machine to be simultaneously utilized as a linear drive of the nozzle(s) in the direction towards the mine face, so that an accordingly relatively small veil will brush over a large axial length during the displacement of the base frame or machine frame.

The configuration in this case is advantageously devised such that the nozzles are arranged on the front part of the machine frame upstream of the operator stands for the machine and anchor boring and setting device operators, viewed in the advance working direction. The operators are, thus, prevented from staying within the flows of rock dust and the ventilation suction ducts pulled forward to the mine face. The nozzles preferably exhibit an overall flow characteristic that encompasses the roof and lateral wall surfaces laid bare, wherein, in a particularly preferred manner, at least two nozzles have fan-out cross sections extending over a central angle of more than 150°, preferably 180°, normal to the longitudinal axis of the machine. Nozzles having such exit cross sections are able to spray the rock flour to be blown out substantially in a plane extending orthogonal relative to the longitudinal axis of the machine, whereby it is at the same time ensured that a relatively large region of the roof and lateral walls will be reliably covered.

In a particularly advantageous manner, the configuration is devised such that the nozzles distribute the jet of each nozzle at an angle of between 0° and 15° from the vertical plane to a plane inclined relative to the front end of the machine. Such an inclination of the exit angle of each nozzle in the direction towards the mine face results in an enhanced distribution of the rock flour on the surfaces to be sprayed and, in addition, causes an enhanced removal of the binder air flow by suction after binding with the superficial carbon dust through a suction duct in the immediate vicinity of the mine face. In the main, the machine operators can thus be kept free of impediments by dusting. In order to provide the optimum protection of the nozzles during the cutting or mining operation, the configuration advantageously is devised such that the nozzles are designed to comprise controllable caps for closing and clearing the exit cross sections.

Especially good covering of the region to be protected will be ensured in that one nozzle is each arranged on either side of the longitudinal central axis of the machine frame, whereby it has been shown that a largely complete protection can already be obtained by but two of such nozzles.

In a particularly advantageous manner, the configuration is devised such that anchor boring and setting devices are connected with the machine frame and that the nozzles are arranged on the front end of the machine upstream of said anchor boring and setting devices, seen in top view. Anchor boring and setting devices must be disengaged during the displacement of the machine frame, as must the pertinent supports between roof and floor, wherein such anchor boring and setting devices frequently also include flushing means to remove drillings by the aid of compressed air. Such air compressors in a particularly simple manner can be used to introduce rock dust and/or binder in the phases where no anchoring or boring takes place, the required accessory device in a thus adapted advance working or mining machine thus being limited to a transport unit for stone powder and the pertinent nozzles.

With a machine-integrated rock dust discharge device of this type, it is feasible to run the usual mining program without any downtime, since the time required even during continuous operation for the follow-on procedure of the advance working machine can be used for dusting.

BRIEF DESCRIPTION OF THE DRAWING

In the following, the invention will be explained in more detail by way of an exemplary embodiment schematically illustrated in the drawing, of a device that is particularly suitable to carry out the method according to the invention. In the drawing.

DETAILED DESCRIPTION OF A PREFERRED EMBODIMENT OF THE INVENTION

Figure 1:
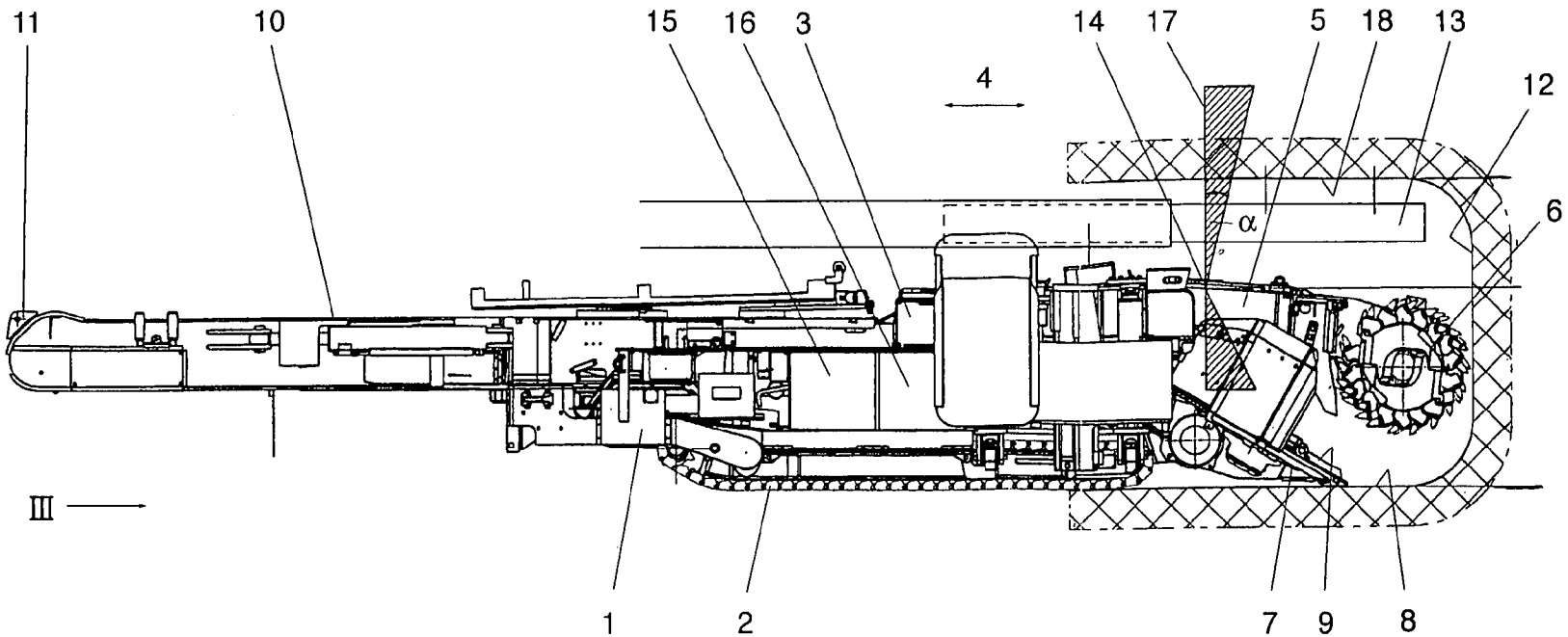
FIG. 1 is a schematic side view of an advance working and mining machine according to the invention.

In FIG. 1, the machine frame 1 of an advance working or mining machine, respectively, is displaceable by means of a crawler mechanism 2. A carriage 3 carrying a pivotable cantilever arm 5 is mounted on the machine frame so as to be movable in the sense of double arrow 4. Cutting rolls 6 are rotationally mounted on the pivotable cantilever arm 5. The advance working and mining machine, furthermore, comprises a loading device 7, by which the cut material can be taken up from the floor 8 by the aid of pivotable arms 9 and further conducted to a haulage device. The haulage device in this case is comprised of a machine-integrated first section 10 which is accordingly pivotable and adjustable in height and, on its discharge end 11, delivers material onto consecutive track conveyors.

The cutting rolls 6 work the mine face 12, and after completion of an outbreak and lowering of the rolls 6 by pivoting the cutting arm 5 in a substantially vertical direction it is feasible to move the carriage 3 back in the sense of the double arrow while simultaneously projecting a duct schematically indicated by 13 to close to the mine face 12. After this, during the return of the carriage, the machine can be moved forward to the mine face 12 in the sense of double arrow 4 along with its machine frame by means of the crawlers of the crawler mechanism 2.

Figure 2:
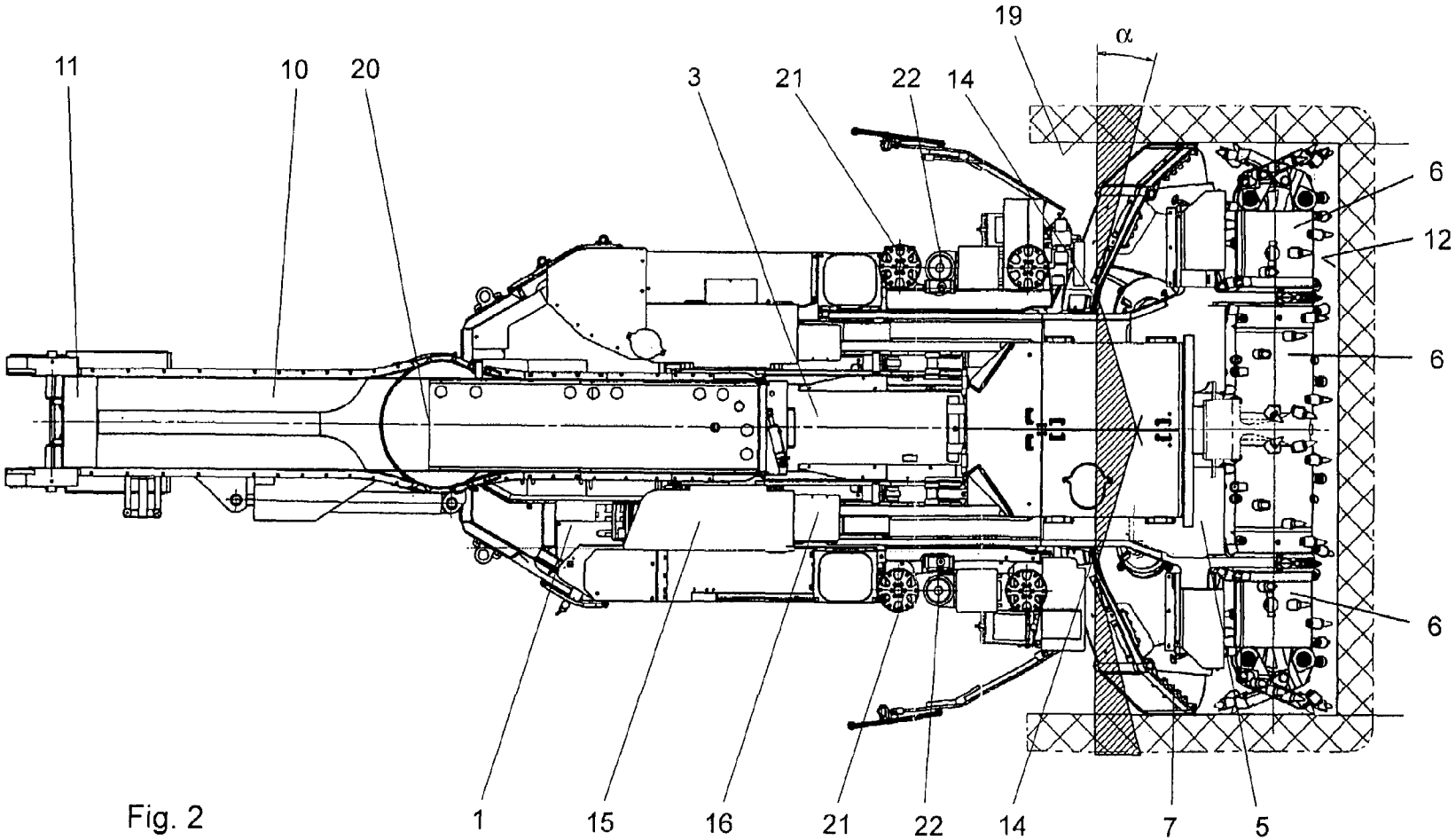
FIG. 2 is a top view on such an advance working machine.

In the course of such a displacement of the machine into a new position in which the machine will again be supported, the nozzles 14 are being switched on and powered with compressed air by a compressor schematically indicated at 15, whereby rock dust will be transported to the nozzles from a suitable storage container 16 and ejected through the nozzles. The ejection is effected in a plane 17 extending substantially parallel with the plane of the mine face 12, wherein the nozzles are designed and adjusted in a manner so as to form a cone inclined relative to the mine face and extending over an angle $\alpha$ of approximately 15°. Due to the displacement of the machine frame 1, this dusting jet sweeps over the roof 18 and the lateral walls 19, as is particularly apparent from the top view of FIG. 2. Thus, all of the roof 18 and lateral walls 19 are, at the same time, largely swept over to the major extent by only two such nozzles 14 with the jet, which extends over the central angle $\alpha$ of 15°, being brought forward to the mine face 12 so as to cause appropriate dust binding close to the mine face. From the illustration according to FIG. 2, the lateral pivotability of the haulage device 10 about a substantially vertical axis 20 is, moreover, apparent. Furthermore, supporting props 21 are visible in FIG. 2, which can be braced between roof and floor in the respective operating position of the cutting machine. In addition, FIG. 2 schematically indicates the anchor boring and setting devices 22, which will enter into action in such a braced position and can be suitably pivoted in during the displacement of the machine or machine frame 1 in order not to impede the maneuverability of the same.

Figure 3:
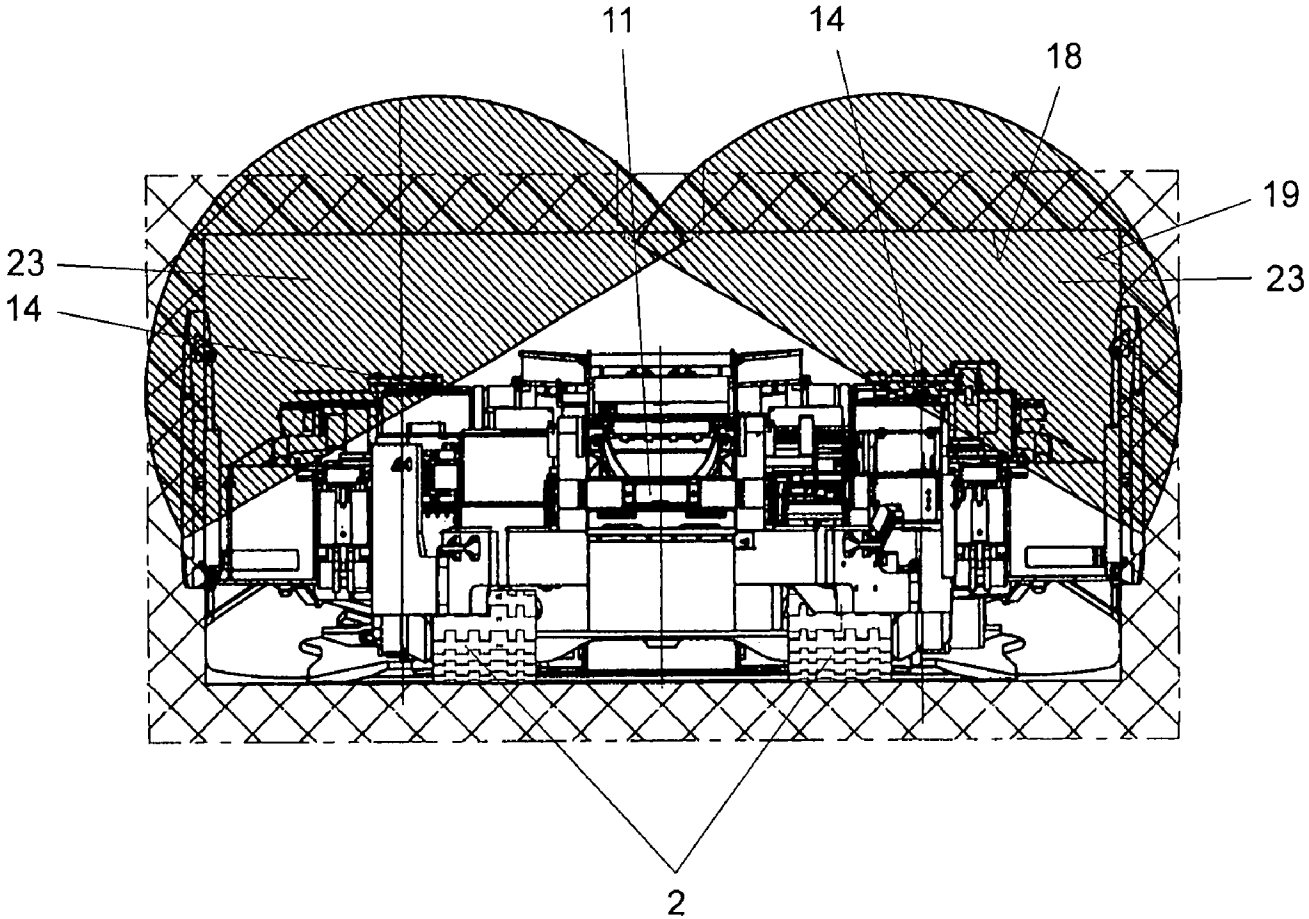
FIG. 3 is a view in the sense of arrow III of FIG. 1 and FIG. 2, respectively, on such a machine in the direction towards the mine face.

From the illustration according to FIG. 3, the crawler mechanism 2 and the rear delivery end 11 of the machine-integrated conveyor 10 are again apparent. In this view, the nozzles 14 each sweep over a region of 180° indicated by hatching 23 and, as a result, cover both the lateral walls 19 and the roof 18 with an accordingly small overlap in the central zone such that full coverage will be guaranteed. The orientation of the nozzles is simply chosen such that the deepest point reached, of the lateral wall 19 is located below the position of the nozzles themselves, whereby the base edge of the jet extending over 180° is pivoted down from the horizontal plane by approximately 30° in accordance with region 23. With the appropriate arrangement of the two nozzles, these base edges will again meet with the roof 18 while overlapping in the roof region within the track center so as to enable an accordingly largely complete coverage of the area to be protected by means of only two nozzles.

The necessary amount of dust to be applied is each determined separately by the local safety provisions. A usual quantity applied would, for instance, be 0.8 kg rock dust per $m^2$ of track surface laid bare. In order to enable the utilization of the maximum moving speed of the advance working machine, the conveying performance of the screw conveyor must be adapted accordingly.

With an excavation depth of, e.g., 1.37 m, approximately 11 kg rock dust will have to be blown onto the roof and lateral walls at the respective track profile in order to ensure sufficient binding with the superficial carbon dust. At a moving speed of the advance working machine of 4 m/min, this results in a displacement time of about 25 seconds. Thus, 11 kg of rock dust are to be blown in 25 seconds. The conveying performance of the screw conveyor and the air compressor are to be adapted accordingly.

We claim:

1. A method for introducing and blowing rock dust to bind carbon dust during advance working or coal mining using an advance working or mining machine, respectively, including a displaceable machine frame and cutting tools and nozzle means arranged on said displaceable machine frame, which method comprises the steps of cutting an outbreak or excavation by said cutting tools in a first cutting or excavation position so as to lay bare roof and lateral wall surfaces;

retracting said cutting tools relative to said displaceable machine frame; and displacing said displaceable machine frame into a further cutting or excavation position while blowing out rock dust by aid of a pressure medium through said nozzle means onto said roof and lateral wall surfaces laid bare by said cutting tools, and positioning at least one exhaust duct in a direction towards a mine face prior to blowing out said rock dust.

2. A method as set forth in claim 1, wherein said pressure medium is comprised of compressed air.

3. A method for introducing and blowing rock dust to bind carbon dust during advance working or coal mining using an advance working or mining machine, respectively, including a displaceable machine frame and cutting tools and nozzle means arranged on said displaceable machine frame, which method comprises the steps of cutting an outbreak or excavation by said cutting tools in a first cutting or excavation position so as to lay bare roof and lateral wall surfaces;

retracting said cutting tools relative to said displaceable machine frame; and displacing said displaceable machine frame into a further cutting or excavation position while blowing out rock dust by aid of a pressure medium through said nozzle means onto said roof and lateral wall surfaces laid bare by said cutting tools wherein at least one suction duct is provided, and which further comprises the step of displacing and positioning said at least one suction duct in a direction towards a mine face prior to blowing out said rock dust.

4. A method as set forth in claim 1, wherein at least one cap is provided on said nozzle means, and which further comprises the step of removing said at least one cap from said nozzle means prior to blowing out said rock dust.

5. A method as set forth in claim 1, wherein at least one cap is provided on said nozzle means, and which further comprises the step of opening said at least one cap prior to blowing out said rock dust.

6. A method as set forth in claim 2, wherein there is provided a blow-out duct for blowing out said rock dust and a mechanical conveying means for mechanically conveying said rock dust into said blow-out duct, and further comprising the steps of mechanical conveying, and of switching on and off said compressed air, effected in a time-delayed manner relative to said mechanical conveying.

7. A method as set forth in claim 6, wherein said mechanical conveying means is comprised of a screw conveyor.

8. A method as set forth in claim 1, wherein following-on of said advance working or mining machine is effected in a time delayed manner relative to said blowing out of said rock dust.

9. An advance working or mining machine to be used for introducing and blowing rock dust to bind carbon dust during advance working or coal mining, comprising a displaceable machine frame, a carriage movably mounted on said machine frame and carrying a pivotable cantilever arm, cutting heads or rolls rotationally mounted on said pivotable cantilever arm and constructed to cut an outbreak or excavation so as to lay bare roof and lateral wall surfaces, a loading means constructed to receive cut or broken material, at least one nozzle means arranged on said displaceable machine frame and constructed to atomize rock dust, said nozzle means having an overall flow characteristic encompassing said roof and lateral wall surfaces laid bare, wherein one nozzle means is each provided on either side of a longitudinal central axis of said displaceable machine frame, and at least one storage bin and a compressed-air source arranged on said advance working or mining machine.

10. An advance working or mining machine as set forth in claim 9, further comprising anchor boring and setting means and operating stand means provided for operators of said machine and anchor boring and setting means, and wherein said nozzle means are arranged on a front part of said displaceable machine frame upstream of said operating stand means, viewed in an advance working direction.

11. An advance working or mining machine as set forth in claim 9, wherein at least two of said nozzle means each have a fan-out cross section extending over a central angle of more than 150° normal to a longitudinal axis of said machine.

12. An advance working or mining machine as set forth in claim 11, wherein said fan-out cross section extends over a central angle of 180° normal to a longitudinal axis of said machine.

13. An advance working or mining machine as set forth in claim 9, wherein said nozzle means are constructed to distribute a jet of each one of said nozzle means at an angle of between 0° and 15° from a vertical plane to a plane inclined relative to a front end of said machine.

14. An advance working or mining machine as set forth in claim 9, wherein each of said nozzle means defines a nozzle exit cross section, and which further comprises a controllable cap means provided on each of said nozzle means for closing and clearing said nozzle exit cross section.

15. An advance working or mining machine as set forth in claim 9, further comprising anchor boring and setting means connected with said displaceable machine frame, and wherein said nozzle means are arranged on a front end of said machine upstream of said anchor boring and setting means, seen in top view.

* * * * *

UNITED STATES PATENT AND TRADEMARK OFFICE

CERTIFICATE OF CORRECTION

PATENT NO. : 7,048,340 B2
APPLICATION NO. : 10/739774
DATED : May 23, 2006
INVENTOR(S) : Lammer et al.

It is certified that error appears in the above-identified patent and that said Letters Patent is hereby corrected as shown below:

Title Page,

In Item [73], Assignee, after "Voest-Alpine Bergtechnik," insert the following:

--Gesellschaft m.b.H.--

Signed and Sealed this

Twenty-seventh Day of March, 2007

JON W. DUDAS
*Director of the United States Patent and Trademark Office*